United States Patent [19]

Pohan

[11] 4,298,040

[45] Nov. 3, 1981

[54] FILL DEVICE

[75] Inventor: Kurt Pohan, Freigericht, Fed. Rep. of Germany

[73] Assignee: Leybold-Heraeus GmbH, Cologne, Fed. Rep. of Germany

[21] Appl. No.: 92,926

[22] Filed: Nov. 8, 1979

[30] Foreign Application Priority Data

Nov. 8, 1978 [DE] Fed. Rep. of Germany ..... 2848436

[51] Int. Cl.[3] ..... B65B 3/02

[52] U.S. Cl. ..... 141/115; 141/269; 141/285

[58] Field of Search ..... 141/250-284, 141/165, 166, 115, 37-66, 285-310, 116-127

[56] References Cited

U.S. PATENT DOCUMENTS

| | | | |
|---|---|---|---|
| 491,753 | 2/1893 | Jones | 141/269 |
| 924,360 | 6/1909 | Kirkegaard | 141/269 |
| 1,051,179 | 1/1913 | Wiberg | 141/269 |

*Primary Examiner*—Houston S. Bell, Jr.
*Attorney, Agent, or Firm*—Spencer & Kaye

[57] ABSTRACT

A fill device for filling a system, via a fill pipe thereof, with a liquid to a selected fill level, which device includes a housing, a rod axially displaceably mounted in the housing with one end of the rod forming a liquid outlet opening arranged to extend into the fill pipe to the selected level, a flow control unit connected between the outlet opening and connections for liquid supply and extraction lines and operable to connect a selected one of those lines to the outlet opening, a clamping mechanism mounted in the region of the outlet opening and operable to clamp the device onto the fill pipe, and an operating member operatively associated with the rod, the flow control unit and the clamping mechanism for causing displacement of the rod relative to the housing to simultaneously control operation of the flow control unit and the clamping mechanism.

11 Claims, 3 Drawing Figures

FILL DEVICE

BACKGROUND OF THE INVENTION

The invention relates to a fill adapter for liquids to which is connected at least one liquid supply line and one extraction line for excess liquid.

Fill adapters of this type serve to supply liquid systems with their operating liquids, for example, to supply coolant circulation systems with coolant or—in the manufacture of automobiles—to supply brake systems with brake fluid or radiator systems with radiator fluid. Particularly in the automobile industry such filling processes must be performed extremely quickly while maintaining a given fill level.

Prior art fill adapters are attached to the system to be supplied by first fastening the adapter in a fill pipe of the system with the aid of a clamping device. Then a valve is opened so that the desired liquid can flow from a supply station into a system of conduits. Frequently this involves a circulating system, i.e. the liquid being supplied is removed again at another point of the system and returned to the supply station until the entire system is clean and free of gases. In the case of filling brake line systems with brake fluid, a vacum degasification of the fluid may take place additionally in the supply station.

Once the filling process is completed, the fill valve is closed and a suction valve is opened to suck off part of the liquid in the area of the fill pipe so that a precisely defined fill level is reached. The final operation is then the release of the clamping device from the respective fill pipe.

SUMMARY OF THE INVENTION

It is the object of the present invention to provide a space saving, easily handled fill adapter of the above-mentioned type with which the filling process can be performed simpler and faster than has previously been possible.

This is accomplished according to the present invention in that the fill adapter is provided with a rod having an axial channel and being axially displaceable with respect to the adapter housing. One end of the rod forms the fill opening which extends into the respective fill pipe to the desired fill level. A displacement of the rod simultaneously actuates a clamping device provided for holding the adapter and being desposed in the area of the fill opening so as to move it onto the respective fill pipe. Means are also provided for controlling the filling or extraction process, respectively.

With a fill adapter of such design, the clamping and filling processes can be performed simultaneously as can the extraction and release processes, so that no time is lost between fastening or releasing the fill adapter and controlling the filling process. The entire filling process can thus be performed in the shortest possible time. Due to the fact that, inter alia, the actuating rod and the channel disposed therein are formed by but a single component, the adapter is small, lightweight and easily maneuvered which is of great significance in particular in the manufacture of automobiles because of the constricted space conditions in the area of the engine.

Moreover, the adapter is useful in sterile areas or in nuclear plants where manual operation is impossible and the movements for clamping, filling and extraction must be reduced to a minimum. The adapter need only be moved vertically up and down.

It is of particular advantage if the rod is fastened to a piston which is part of a pneumatically or hydraulically operated cylinder-piston device. Automatic operation of the fill adapter is then particularly easy.

In a further advantageous embodiment, the means for controlling the fill or extraction process, respectively, are disposed on the end of the rod facing away from the fill opening. This makes it possible to arrange the fill opening, the cylinder-piston device for actuating the rod and the means for controlling the fill or extraction process axially behind one another in such a way that the control means for the filling or extraction process, respectively, are preferably placed at the point where the liquid supply line, the extraction line and also the pressure medium line for actuation of the cylinder-piston unit are connected to the adapter housing.

DESCRIPTION OF THE PREFERRED EMBODIMENTS

Figure 1:
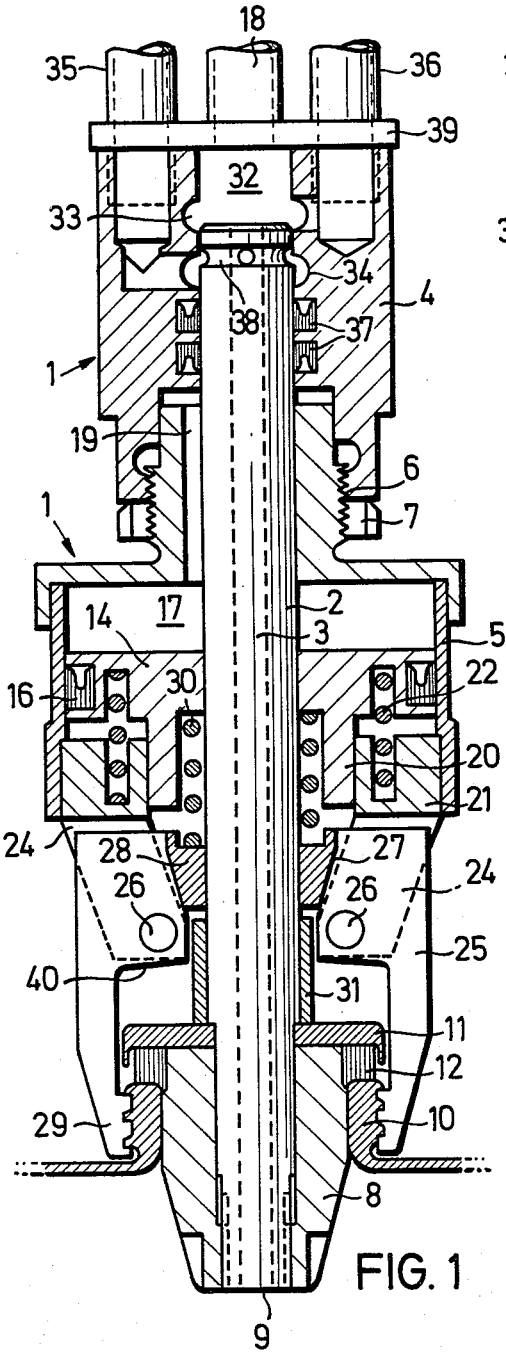
FIG. 1 is a side, cross-sectional view of a preferred embodiment of an adapter according to the invention.

The illustrated embodiment essentially includes an adapter housing 1 and a rod 2 which is axially displaceable in the housing. Rod 2 is provided with a channel 3 formed by a bore which is preferably coaxial with the rod.

The adapter housing 1 is composed of two parts 4 and 5, which are releasably connected together by threaded engagement at 6 and a detent ring 7. The thread 6 and the detent ring 7 are designed so as to connect housing members 4 and 5 with different spacings therebetween.

The rod 2 containing the channel 3 for the liquid passes through both housing members 4 and 5 and is provided with a nozzle 8 at its lower end. This nozzle 8, whose lower end forms the fill opening 9, serves to introduce the rod with its channel 3 into the respective fill pipe 10. During the filling process, a flange 11, which is also fastened to the rod 2, rests with its sealing ring 12 on the upper edge of the fill pipe 10 so that the required seal is assured.

In order to be able to axially displace rod 2 in housing 1, rod 2 is provided with a piston 14 in the area of housing member 5. This piston 14 is displaceably mounted in the upper section of housing member 5 and is sealed by means of a sealing ring 16 in such a manner that the piston 14 moves downwardly when the space 17 above the piston 14 is charged with a pressure medium. The pressure medium, which is preferably compressed air, is supplied through a supply line 18, which is connected via channels (not visible) to a longitudinal groove 19 which opens into space 17.

The piston 14 has a cylindrical sleeve portion 20 which is guided in a supporting ring 21 permanently fixed to housing member 5. Between piston 14 and supporting ring 21 there is disposed a compression spring 22 which causes the piston 14 to take on its upper end position when space 17 (and 32) is not being charged with pressure medium.

A plurality of bars 24, only two of which are visible, are fastened to housing member 5, each bar being provided. with a pivotally fastened claw 25.

Above its pivot axis 26, each claw 25 is provided with a face 27 which has an oblique orientation with respect to the piston rod 2. These oblique faces 27 are associated with a cone 28 on the piston rod 2 in such a manner that the lower ends 29 of the claws 25 move toward one another if the piston rod 2 and the cone 28 move downwardly. The shape of the lower ends 29 of the claws 25 is adapted to the external shape of the fill pipe 10.

If the piston rod 2 moves upwardly, the claws 25 will spread open since the flange 11 will then impinge on the oblique surfaces 40 of the claws 25. Claws 25 then open up toward the outside around their pivot axes 26.

Between the cone 28 and the piston 14 there is disposed a further compression spring 30 which presses the cone 28 against the faces 27 of the claws 24 and thus reliably prevents the claws from opening suddenly during a clamping phase. Above flange 11 on rod 2, there is a sleeve 31. When the rod 2 moves upwardly sleeve 31 carries along cone 28 and thus makes it possible for the claws 25 to open.

The means for controlling the filling or extraction process, respectively, are accommodated in housing member 4. This control is also effected by axial displacement of the piston rod 2. For this purpose, housing member 4 is provided with a cylindrical chamber 32 into which extends the upper end of the piston 2. Two annular grooves 33 and 34 placed axially one after the other are provided in the cylindrical chamber wall. The annular groove 34 is in communication with a supply line 35 which, in the illustrated embodiment, serves to supply the respective operating fluid. The annular groove 33 is in communication with a supply line 36 which is connected to an extraction device (not shown). The cylinder chamber 32 is sealed off with respect to the piston rod 2 by sealing rings 37.

Figure 2:
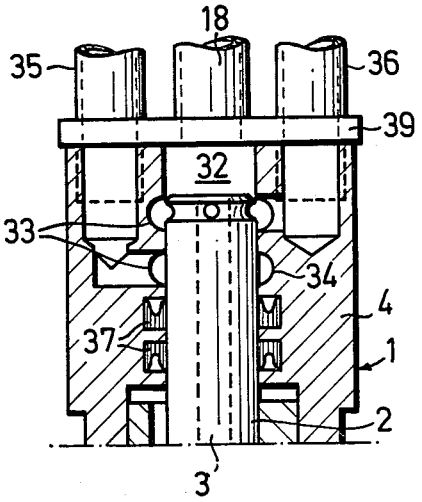
FIGS. 2 and 3 are cross-sectional views of part of the device of FIG. 1 in two different operating positions.

The annular grooves 33 and 34 in the wall of cylinder 32 have associated with them an annular groove 38 in rod 2. The axial channel 3 in rod 2 opens into this annular groove 38. The size of the grooves 33, 34 and 38, the spacing between grooves 33 and 34 and the distance of the upper grooves 33 from the upper end of the cylinder chamber 32, defined by a cover plate 39, are selected and given dimensions such that displacement of rod 2 will cause the channel 3 disposed therein to be connected either to liquid supply line 35, via annular grooves 38 and 34 (FIG. 1) or—in another position of rod 2—to suction line 36, via annular grooves 38 and 33 (FIG. 2).

When the piston rod 2 is in its uppermost position (FIG. 3) the lines 35 and 36 to the adapter are both closed. That is the rest position of the adapter in which the claws 25 are spread open as well.

A filling process employing the adapter according to the invention proceeds as follows:

In its rest position, the adapter with its seal 12 is placed onto the fill pipe 10. Then pressure medium is introduced into the cylinder chamber 17 through the supply line 18 so that the piston rod 2 moves downwardly. During this downward movement, the claws 25 move toward one another and grip the fill pipe 10 for the purpose of clamping onto and sealing it. At the same time, the annular groove 38 in the piston rod 2 moves into the position shown in FIG. 1. In this postion, channel 3 is connected with the supply line 35 so that the desired operating fluid flows in.

During this downward movement there existed for a certain period of time a connection between the suction line 36 and the channel 3 in the piston rod 2. If necessary, this position can be maintained for a sufficiently long time to generate a subatmospheric pressure in the system to be filled.

However, it will generally be the desire to begin the introduction of fluid as quickly as possible after the adapter has been placed onto the fill pipe 10. In the adapter according to the invention this time is extremely short since the connection between the supply line 35 and the channel 3 in the piston rod 2 is established simultaneously with seating the adapter on the fill pipe 10.

Once the filling process is completed, upward movement of the piston rod 2 is initiated by reducing the pressure in the cylinder chamber 17. The piston rod 2 will move upwardly at a speed dependent on the rate of pressure reduction and the strength of the spring 22.

During this upward movement, the connection of channel 3 with supply line 35 is interrupted and for a time which depends on the speed of the piston rod 2 a connection is established between the channel 3 and the suction line 36, as shown in FIG. 2. During this time, excess liquid is sucked away until a desired fill level is reached which depends on the height of the fill opening 9, and at the same time this helps to prevent dripping after the flow of liquid has been shut off.

Figure 3:
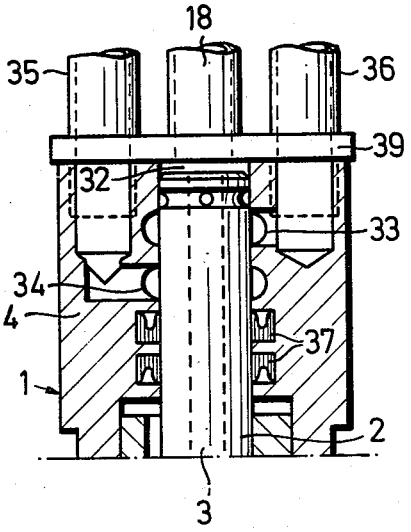

Then the piston rod 2 moves into the position shown in FIG. 3 in which claws 25 are spread open so that the adapter can be removed from the fill pipe 10. Due to the fact that the two housing members 4 and 5 can be set and fixed at different distances from one another, the amount of overlap of annular grooves 33 and 34 over annular groove 38 can be varied infinitely.

It can be seen that appropriate movement of the piston rod 2 permits the clamping and filling processes, or the releasing and extracting processes, respectively, to take place at approximately the same time. Thus these processes can take place in the shortest possible time. The adapter is lightweight and handy and its diameter is not much larger than that of the fill pipe 10. In the illustrated embodiment, a linear movement has been selected for the piston rod 2. Of course, the above-described measures can also be accomplished by a rotary movement of rod 2. The mechanism would then have to be modified accordingly.

I claim:

1. A fill device for filling a system, via a fill pipe thereof, with a liquid to a selected fill level, at least one liquid supply line and one extraction line being connected to said device and said device comprising: a housing; a rod axially displaceably mounted in said housing with one end of said rod forming a liquid outlet opening arranged to extend into the fill pipe to the selected fill level; flow control means connected between said outlet opening and the supply and extraction lines and operable to connect a selected one of those lines to said outlet opening; clamping means mounted in the region of said outlet opening and operable to clamp said device onto the fill pipe; and operating means operatively associated with said rod, said flow control means and said clamping means for causing displacement of said rod relative to said housing to simultaneously control operation of said flow control means and clamping means.

2. Fill device as defined in claim 1 further comprising a fluid-operated piston-cylinder unit, the piston of which is fastened to said rod, for controlling the displacement of said rod relative to said housing.

3. Fill device as defined in claim 1 or 2 wherein said flow control means are disposed at the end of said rod opposite said one end forming said outlet opening.

4. Fill device as defined in claim 3 wherein said flow control means comprise a control cylinder fixed to said housing and in which said end of said rod opposite said one end thereof is disposed, said rod is provided with a fluid flow channel extending between said outlet opening and the region enclosed by said control cylinder, and said control cylinder is provided with a cylinder wall provided with two openings spaced apart in the direction of the axis of said rod and each in communication with a respective one of the liquid supply line and the extraction line.

5. Fill device as defined in claim 4 wherein said openings are constituted by two annular grooves formed in said control cylinder wall.

6. Fill device as defined in claim 4 wherein said rod is provided, at the end opposite said one end thereof, with an annular groove formed in its external lateral surface and via which said channel communicates with the region enclosed by said control cylinder.

7. Fill device as defined in claim 6 wherein said openings are constituted by two annular grooves formed in said control cylinder wall.

8. Fill device as defined in claim 2 wherein said piston is arranged to be driven in the direction of said outlet opening by a pneumatic pressure fluid, and further comprising a spring mounted between said piston and said housing for urging said piston in the direction away from said outlet opening.

9. Fill device as defined in claim 1 further comprising a nozzle fastened to said rod in the region of said outlet opening, and a sealing means associated with said nozzle for creating a seal between said nozzle and the fill pipe.

10. Fill device as defined in claim 1 wherein said housing is composed of two parts connected together in a manner to permit the positions of said parts relative to one another along the axis of said rod to be varied.

11. Fill device as defined in claim 1 wherein said flow control means define a first passage via which said flow control means communicate with the supply line and a second passage via which said flow control means communicate with the extraction line, said passages being spaced apart in the direction of displacement of said rod, and said operating means are operable for moving said rod into a first position in which said outlet opening is connected to only said first passage and into a second position in which said outlet opening is connected to only said second passage.

* * * * *